US006877848B2

(12) United States Patent
Shimizu et al.

(10) Patent No.: US 6,877,848 B2
(45) Date of Patent: Apr. 12, 2005

(54) LIQUID CONTAINER, CONNECTION UNIT FOR LIQUID CONTAINER, AND INK JET RECORDING APPARATUS

(75) Inventors: Eiichiro Shimizu, Yokohama (JP); Hajime Yamamoto, Yokohama (JP); Hiroshi Koshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/256,371

(22) Filed: Sep. 27, 2002

(65) Prior Publication Data

US 2003/0085968 A1 May 8, 2003

(30) Foreign Application Priority Data

Sep. 28, 2001 (JP) ..... 2001-302091

(51) Int. Cl.[7] ..... B41J 2/175
(52) U.S. Cl. ..... 347/86
(58) Field of Search ..... 347/49, 86, 87

(56) References Cited

U.S. PATENT DOCUMENTS

| | | | | |
|---|---|---|---|---|
| 4,700,202 A | | 10/1987 | Kuranichi et al. | 346/140 R |
| 6,022,101 A | | 2/2000 | Sabonis | 347/84 |
| 6,132,036 A | | 10/2000 | Abe et al. | 347/86 |
| 6,135,590 A | * | 10/2000 | Saeki et al. | 347/86 |
| 6,322,205 B1 | * | 11/2001 | Childers et al. | 347/85 |
| 6,702,427 B2 | | 3/2004 | Shimizu et al. | 347/50 |
| 6,712,458 B2 | | 3/2004 | Hatasa et al. | 347/86 |
| 6,742,857 B2 | | 6/2004 | Koshikawa et al. | 347/19 |
| 2002/0122103 A1 | | 9/2002 | Yamamoto et al. | 347/85 |
| 2003/0071868 A1 | * | 4/2003 | Koshikawa et al. | 347/19 |

FOREIGN PATENT DOCUMENTS

| | | |
|---|---|---|
| JP | 6-64182 | 3/1994 |
| JP | 9-76525 | 3/1997 |
| JP | 11-20185 | 1/1999 |

* cited by examiner

*Primary Examiner*—Anh T. N. Vo
(74) *Attorney, Agent, or Firm*—Fitzpatrick, Cella, Harper & Scinto

(57) ABSTRACT

A liquid container for ink jet recording includes in combination a liquid containing portion having an opening; and a connecting unit having a connecting portion for introducing liquid from an inside of the liquid containing portion.

7 Claims, 11 Drawing Sheets

LIQUID CONTAINER, CONNECTION UNIT FOR LIQUID CONTAINER, AND INK JET RECORDING APPARATUS

FIELD OF THE INVENTION AND RELATED ART

The present invention relates to preferable liquid containers to be used with ink jet recording apparatuses and the like, connective units for liquid containers, and ink jet recording apparatuses in which the liquid containers are mountable.

Recording apparatuses capable of functioning as a printer, a copying machine, a facsimileing machine, or the like, and recording apparatuses used as an output device for a multifunctional electronic device or work station inclusive of a computer, a wordprocessor, etc., are structured for recording images (inclusive of characters, symbols, etc.,) on recording medium (member on which image are recorded), for example, paper, fabric, plastic sheet, OHP, and the like, based on recording information. Recording apparatuses can be classified into an ink jet group, a wire-dot group, a thermal group, a laser beam group, etc.

Among these various types of recording apparatuses, recording apparatuses of an ink jet type (which hereinafter will be referred to as ink jet recording apparatuses) record images by ejecting ink onto recording medium from their recording means. Thus, they enjoy various advantages. For example, their recording means can be easily made compact, and they are capable of recording highly precise images at a high speed. They are capable of recording on ordinary paper without requiring the ordinary paper to be specially treated, and are low in operational cost. Further, they are of a non-impact type, being therefore low in noise. Moreover, color images can be easily recorded with the use of a combination of ink jet recording means and a plurality of inks different in color (for example, color inks).

It is true that ink jet recording apparatuses require recording medium (member on which image is recorded) to meet certain conditions in terms of material. In recent years, however, the advancement in the ink jet technologies made it possible to use some ink jet recording apparatuses to record images on fabric, leather, non-woven fabric, metal, etc., in addition to paper (inclusive of thin paper and specially treated paper), which is an ordinary recording medium, thin resin plate (OHP), etc.

Ink jet recording apparatuses comprise a recording head (ink jet head) having a plurality of microscopic ejection orifices. They record intended images on recording medium (recording paper or the like) by ejecting ink droplets from the microscopic orifices so that the ink droplets land on the recording medium. There are various types of ink jet recording heads. For example, some ink jet heads employ electromechanical transducers such as piezoelectric elements as ejection energy generation elements for generating the energy used for ejecting ink from the ejection orifices, whereas the others employ electro-thermal transducers having a heat generating resistive member. In the case of the latter, ink is heated so that ink droplets are ejected from the ejection orifices.

Also in recent years, the advancement in the software and hardware for computers or the like made it necessary for ink jet recording apparatuses to be capable of outputting color images. Thus, it has been made possible for recording heads (ink jet heads) to record in color. Further, the advancement in the software and hardware for computers or the like made it necessary for ink jet recording apparatuses to be capable of outputting highly precise images. Thus, recording heads (ink jet heads) have been further improved in terms of recording density (density of image or characters), and also, in terms of the change in ink content, making it possible to form even more precise high quality images. As a result, not only have ink jet recording apparatuses come to be used in large cooperation offices by businessmen and computer specialists, but also they have come to be widely used in homes or small offices for personal businesses by ordinary people.

As is evident from the above description, ink jet recording apparatuses are provided with a liquid supplying system (ink supplying system) for supplying a recording means (recording head) with liquid as recording ink. The liquid supplying system is structured so that ink containers (liquid container) for holding ink can be removably connected to the liquid supplying system. More specifically, the ink containers as liquid containers can be removably (exchangeably) mounted in the ink container mounting portion provided in ink jet recording apparatuses.

FIG. 11 is a schematic vertical sectional view of an example of a preferable ink container of an exchangeable type, as a liquid container, in accordance with the prior art, which is employed by ink jet recording apparatuses, and FIG. 12 is an exploded vertical sectional view of the liquid outlet portion (connective portion) of the liquid container in accordance with the prior art, depicted in FIG. 11.

The liquid container 10 (ink container) in FIG. 11 is connected to liquid consuming devices (unshown), such as recording heads or the like, by its connective portions structured as shown in FIG. 12, so that the liquid (ink) can be supplied to the recording heads or the like through a liquid supply tube or the like.

Referring to FIGS. 11 and 12, the ink container 10 comprises an ink storage portion 20 (ink storage proper) in which liquid ink 12 is held, and a pair of connective portions different in location. One of the connective portions is for supplying recording heads with the ink within the ink storage portion, whereas the other is for introducing the ambient air into the ink storage portion. The two connective portions are virtually the same in structure, although they are different in where they are connected. They are each provided with a connective hole 42 (guiding hole), through which a hollow needle (unshown) is inserted into the ink storage portion 20 to establish a passage between the interior and exterior of the ink storage portion.

The ink storage portion 20 (ink storage proper) comprises a portion 22 resembling an open box, and a lid 24 fixed to the edges of the opening of the portion 22 by ultrasonic welding or the like method in a manner to seal the opening. The aforementioned two connective portions 40 are on the lid 24, and are virtually the same in structure. More specifically, each connective portion 40 comprises: a housing portion 26 located on the outward surface of the lid 24; a dorm-like elastic member, which is formed of rubbery elastic material and is kept compressed in the housing portion 26; and a pressing member 46 which retains the elastic member 44 in the housing portion 26 while keeping it compressed. The pressing member 46 is provided with a connective hole 42, which is located in the center of the top portion of the pressing member 46, whereas the housing portion 26 is provided with a connective hole 28, the axial line of which coincides with that of the connective hole 42 of the pressing member 46 after the attachment of the pressing member 46.

In order for the ink container 20 to be used, it must be mounted into an ink jet recording apparatus or the like. As it is mounted into an ink jet recording apparatus, the hollow needle attached to one end of the ink supplying tube, more specifically, the end opposite to the end by which the ink supplying tube is attached to a recording head, goes through the connective hole 42 of one of the connective portions 42, penetrates the elastic member 44 thereof, and goes through the connective hole 28 of the corresponding housing portion 26, whereas the hollow needle, the base end of which is open to the ambient air, goes through the connective hole 42 of the other connective portion 42, penetrates the elastic member 44 thereof, and goes through the connective hole 28 of the other housing portion 26. As a result, it becomes possible for the liquid (ink or the like) within the liquid storage portion 20 to be smoothly supplied to where it is used (ink jet head or the like) as necessary.

There are various methods for firmly fixing the pressing member 46 to the housing portion 26. For example, the external surface of the housing portion 26 may be provided with one side of a latch, whereas the pressing member 46 is provided with other side of the latch, so that the pressing member 46 can be latched to the housing portion 26, or the pressing member 46 may be firmly fixed to the housing portion 26 with the use of ultrasonic welding or the like. The elastic member 44 is shaped like a dome as shown in the drawing. Therefore, as the elastic member 44 is pushed down toward the bottom of the housing portion 26 by the pressing member 46, it is forced to spread in its radius direction while being prevented by the housing portion 26 from spreading in the radius direction. As a result, reactive force, that is, compressive force, is generated in the radius direction.

As one of the connective portions 40 inclusive of the elastic member 44 is completely penetrated by the above described hollow ink supplying needle (unshown), it becomes possible for the ink within the ink container to be supplied to the ink jet head. Similarly, as the other connective portion 40 inclusive of the elastic member 44 is completely penetrated by the above described hollow air introducing needle, it becomes possible for the ambient air to be introduced into the ink container (ink storage portion 20).

The pressing member 46 is provided with a tapered guiding hole 42 (connective hole) for guiding the hollow needle to the center of the elastic member 44. The ink storage portion 20 (more specifically, lid 24) is provided with the through hole 28, which is located in the approximate center of the housing portion 26 in order to allow the hollow needle to go into the ink container. As described before, the elastic member 44 is subjected to the compressive force acting in the radius direction of the elastic member 44. Therefore, it is assured that the interface between the peripheral surface of the penetrating hollow needle and the elastic member 44 remains sealed, preventing the liquid in the liquid container (ink container) from leaking during the mounting or dismounting of the liquid container, or in the like situations.

As described above, one of the two connective portions 40 in FIG. 11 is used as a liquid outlet, whereas the other is used as an air inlet for introducing the ambient air into the liquid storage portion 20 (ink container) to ease the drop in the internal pressure of the liquid storage portion 20 resulting from the consumption of the liquid therein. A liquid container (ink container) such as the one described above is manufactured using the following process. First, the portion 22 like an open box, and lid 24 are weld to each other by ultrasonic welding, and liquid (ink) is poured into the liquid storage portion 20 through the hole 28 of the lid 24. Then, the elastic members 44 are placed in the housings 26, one for one, and the pressing members 46 are attached to the housing portions 26, one for one.

However, the liquid containers (ink containers or the like) structured as described above have the following technical problems.

That is, first, the holes 28 (also connective holes 42) as connective holes each require the housing portion 26 and pressing member 46, making it virtually impossible to reduce the pitch of the holes 28 below a certain value. Therefore, if the number of the holes 28 is large, it is very difficult to reduce the liquid container size.

Secondly, the holes 28 each require the housing portion 26 and pressing member. Therefore, if the number of the holes 28 is large, the numbers of the related components are also large, resulting in the following technical problem. That is, the large number of connective holes 42 (or holes 28) each require the elastic member 44 and the pressing member 46 for pressing the elastic member 44, as well as the space for the aforementioned latch for firmly fixing the pressing member 46. Therefore, it is difficult to reduce the pitch (intervals) of the connective holes 28. Also as described above, the pressing member 46 is necessary for each connective hole 28. Therefore, the elastic members are liable to become nonuniform in the compression ratio, due to the nonuniformity in the component properties.

Thirdly, there is the technical problem that as an ink container increases in size, the lid 24 becomes less likely to be reliably welded to the boxy portion 22 of the ink container. To describe in more detail, in order to increase a liquid container in capacity, it is necessary to increase the liquid storage portion 20 (liquid container 22) in size. As the liquid storage portion 20 is increased in size, the welding surface of the lid 24 also increases, making it difficult to assure the reliability of the welding seam (to ensure that ink does not leak). This is liable to bring about the decline in productivity and yields.

Fourthly, there are the technical problem that the ink storage portion does not handle well after it is filled with ink, and the technical problem, related to the handling of the ink storage portion, that the rubber plugs 44 (elastic members) are liable to be damaged during the filling of the ink storage portion with ink. More specifically, as described above, the connective portions 40 each are attached to the liquid outlet side of the ink storage portion. Therefore, in order to complete the assembly of the connective portions 40, a plurality of steps must be taken, with the holes 28 (through which ink is poured into ink storage portion) remaining open. This is liable to cause ink to leak out of the ink storage portion while the assembly of the ink container is completed. In order to prevent this problem, that is, the ink leakage, an apparatus for capable of holding the ink storage portion without allowing the ink to leak is necessary, or it is necessary to reduce the amount by which ink is poured into the ink container (which results in decrease in ink storage ratio). The larger the ink container, the greater the extent of these problems. In order to eliminate these problems, it is possible to attach the connective portions 40 to the ink storage portion 20 before the pouring of ink into the ink storage portion. If the connective portions 40 is attached to the ink storage portion 20 before the pouring of ink into the ink storage portion, the hollow needle must be put through one of the connective portions 40 in order to fill the ink storage portion 20 with ink. However, the diameter of the hollow needle is not very large (it cannot be very large). Therefore, it takes a long time to fill up the ink storage portion with ink, and also, it is predictable that the elastic members 44 will be damaged by the hollow needle, and that ink will leak from the damaged portions of the elastic members 44.

Fifthly, there is the technical problem that the ink filling step is low in productivity. In order to solve this technical problem, it is possible to provide the ink storage portion with a hole dedicated for pouring ink into the ink storage portion. However, providing the ink storage portion with a hole dedicated for pouring ink into the ink storage portion requires an additional sealing member and so on, as well as an additional manufacturing step, that is, the step for sealing the dedicated ink pouring hole after the pouring of ink into the ink storage portion. This increase the production cost. In other words, this solution is not viable. Thus, ink must be poured into the ink storage portion through the hole 28 of one of the housing portions 26 in which the elastic member 44 is housed. As described before, the holes 28 are for allowing the aforementioned hollow needle to be put through, and cannot be made very large, preventing therefore an ink pouring nozzle from being made very large. Therefore, it takes a long time to fill up the ink storage portion with ink. The severity of this problem increases as the ink container size increases; the larger the ink container size, the greater the productivity loss. To describe in more detail, if the size of the hole 28 is increased, it becomes impossible for the elastic member in the housing portion 26 to be sufficiently compressed for keeping the interface between the hollow needle and elastic member 44 reliably sealed after the elastic member 44 is completely penetrated by the hollow needle to supply the ink jet head with the ink within the ink storage portion. Therefore, the ink within the ink storage portion is liable to leak. Thus, the holes 28 cannot be made very large. It is possible to provide a portion of an ink storage portion other than where the holes 28 are present, with a hole which is dedicated for pouring ink into the ink storage portion, and which is greater in size than the holes 28. However, the addition of this hole dedicated for pouring ink into the ink storage portion requires members for sealing this hole, as well as the manufacturing step for sealing this hole, adding to the production cost.

Sixthly, it is very difficult to manufacture reliable liquid containers with the use of a highly productive manufacturing method. To describe in more detail, as described above, the connective portions 40 are assembled step by step after the pouring of ink into ink storage portion; in other words, the connective portions 40 are assembled while the container 20 remains unsealed. Therefore, special measures must be taken in order to prevent the ink in the ink storage portion 20 from leaking, in order to prevent foreign substances from mixing into the ink within the container 20, and in order to prevent the like problems. This is liable to increase the production cost, and to reduce productivity.

SUMMARY OF THE INVENTION

The present invention was made in view of the above described technical problems, and the primary object of the present invention is to provide a connective unit for a liquid containers, which has a plurality of connective portions, inclusive of a connective portion for drawing liquid and a connective portion for introducing air, and yet, is simple and compact in structure, highly precise, and highly reliable in terms of airtightness and the like properties, so that it becomes possible to provide a liquid container superior in the productivity in terms of the efficiency with which liquid can be poured into the liquid container, and an ink jet recording apparatus in which such a liquid container is mountable.

According to an aspect of the present invention regarding a liquid container, a liquid container for accomplishing the above described object is characterized in that in order to accomplish the above described object, it is made up of a combination of a liquid storage portion having an opening, and a connective unit which comprises a single or plurality of connective portions for making it possible to draw the liquid within the liquid storage portion, and is attached to the opening of the liquid storage portion.

According to another aspect of the present invention regarding an ink jet recording apparatus, an ink jet recording apparatus which ejects ink from its recording means onto recording medium to form images on the recording medium is characterized in that it is provided with a mounting portion in which a liquid container having the above described structure is mountable.

According to a further aspect of the present invention regarding a connective unit, a connective unit, which is to be combined with a liquid storage portion having an opening, in order to make a liquid container for an ink jet, is characterized in that in order to accomplish the above described object, it is provided with a single or plurality of connective portions for making it possible to draw liquid from the liquid storage portion.

According to a further aspect of the present invention regarding to an ink jet recording apparatus, an ink jet recording apparatus which ejects ink from its recording means onto recording medium to form images is characterized in that in order to accomplish the above described object, it is provided with a mounting portion in which a liquid container connectable with the use of a connective unit having the above described structure is mountable.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be concretely described with reference to the appended drawings. Throughout the drawings, the same referential numerals represent the same or equivalent components.

Figure 1:
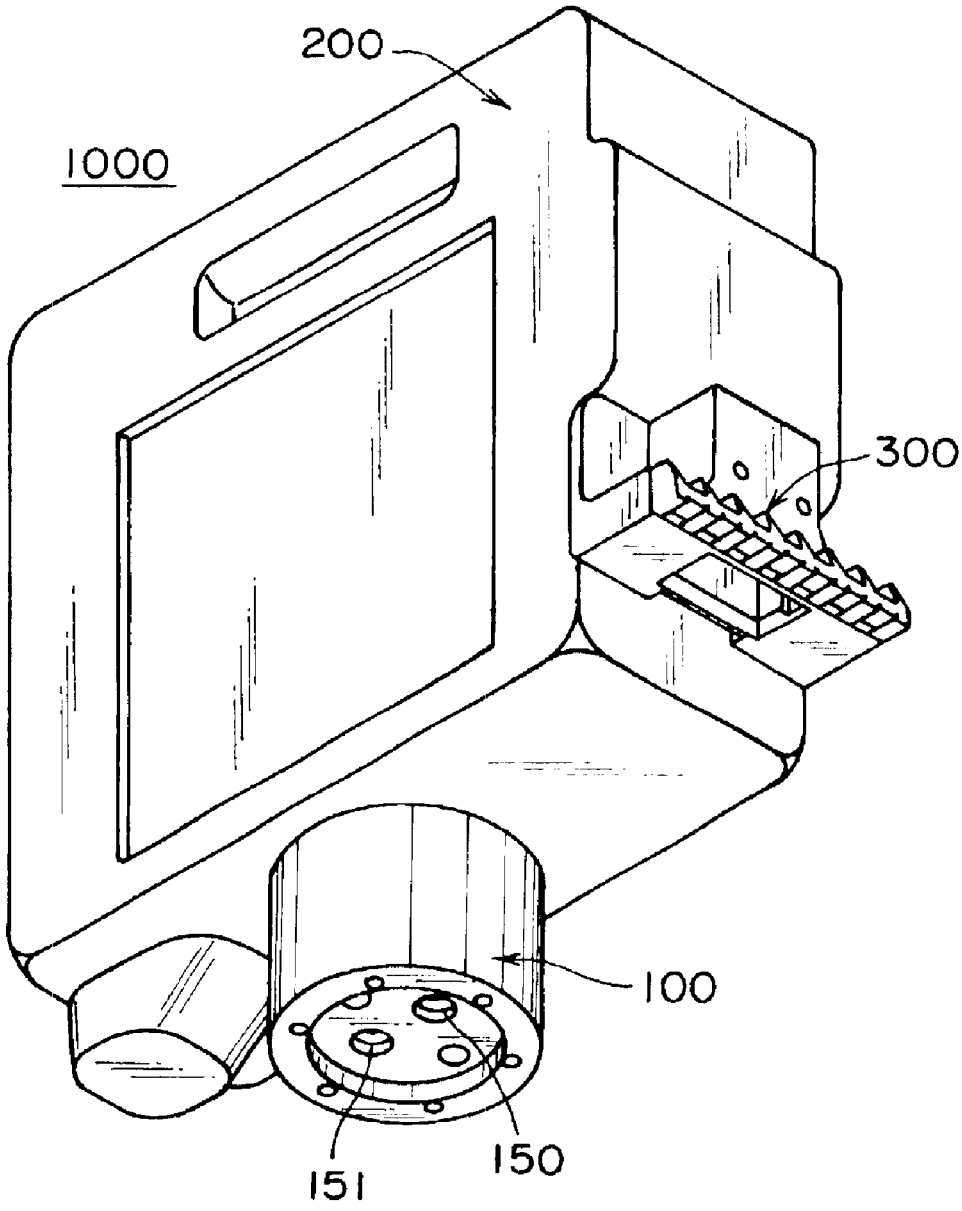
FIG. 1 is a schematic perspective view of the first embodiment of the present invention in the form of a liquid container.
Figure 2:
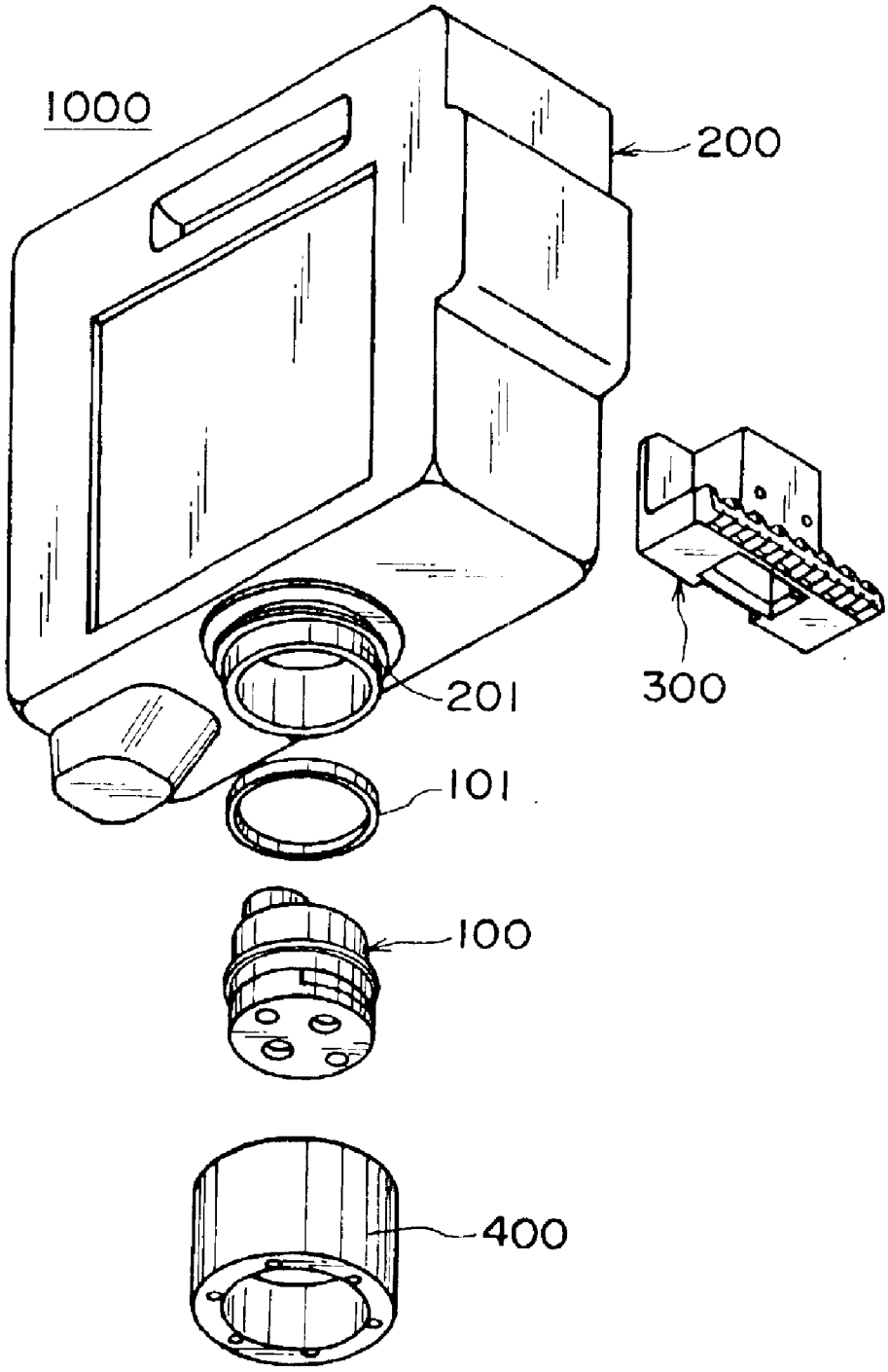
FIG. 2 is an exploded schematic perspective view of the liquid container in FIG. 1, for showing the general structure thereof.
Figure 3:
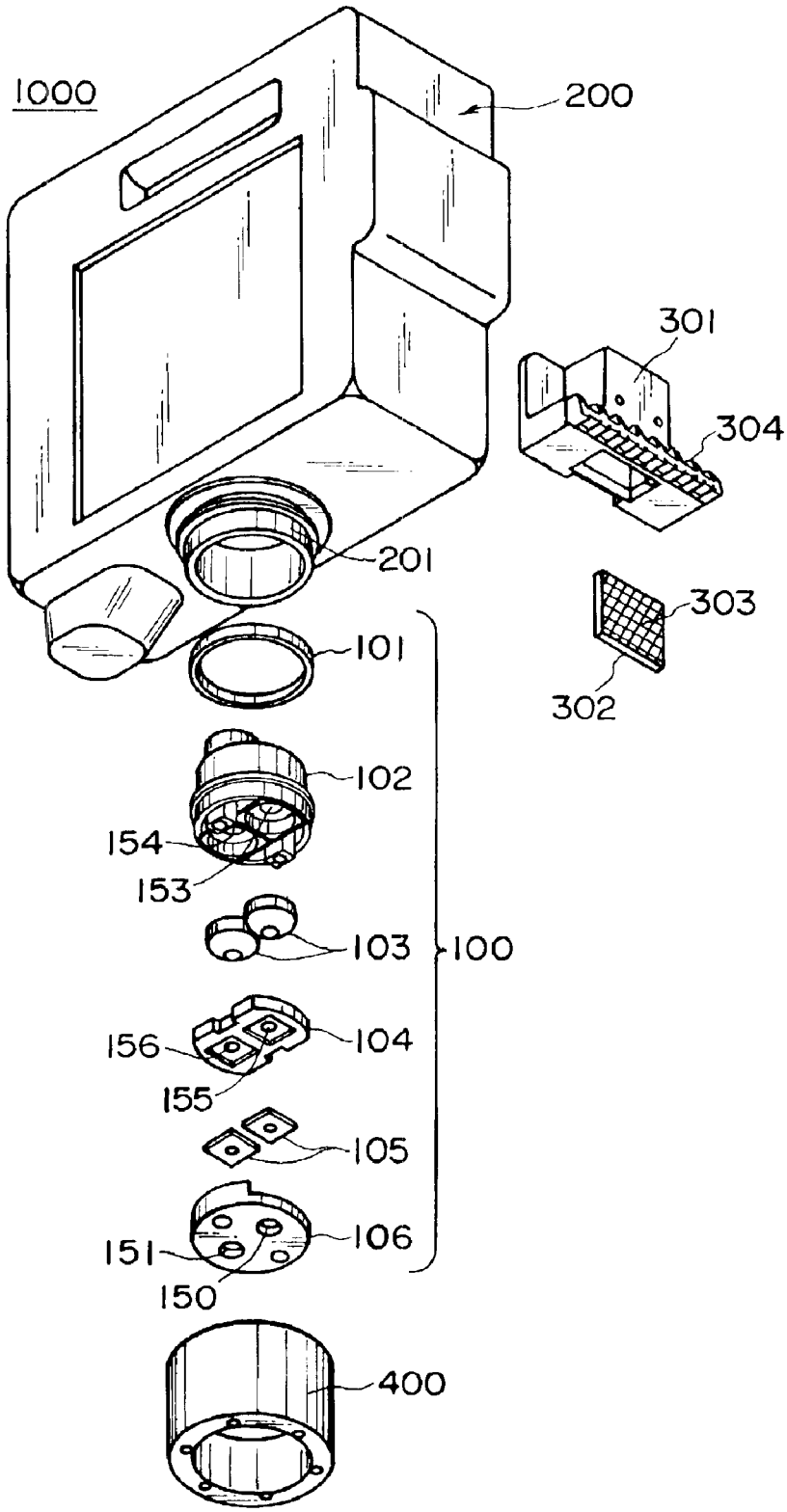
FIG. 3 is an exploded schematic perspective view of the liquid container in FIG. 1, having been further exploded to show the details of the connective unit in FIG. 2.
Figure 4:
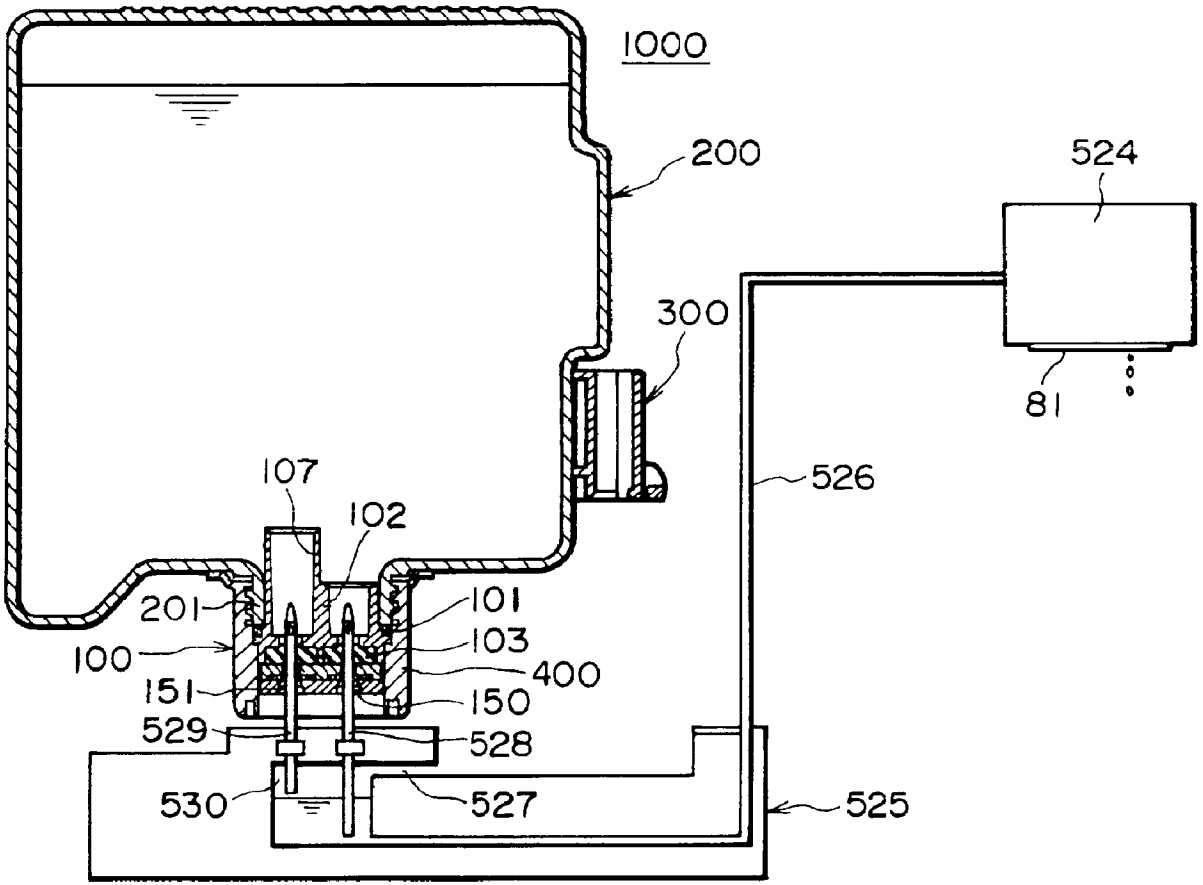
FIG. 4 is a sectional view of the combination of the liquid container in FIG. 1 and the ink supplying system of an ink recording apparatus employing the liquid container as an ink container, for showing the general structure of the ink supplying system.
Figure 5:
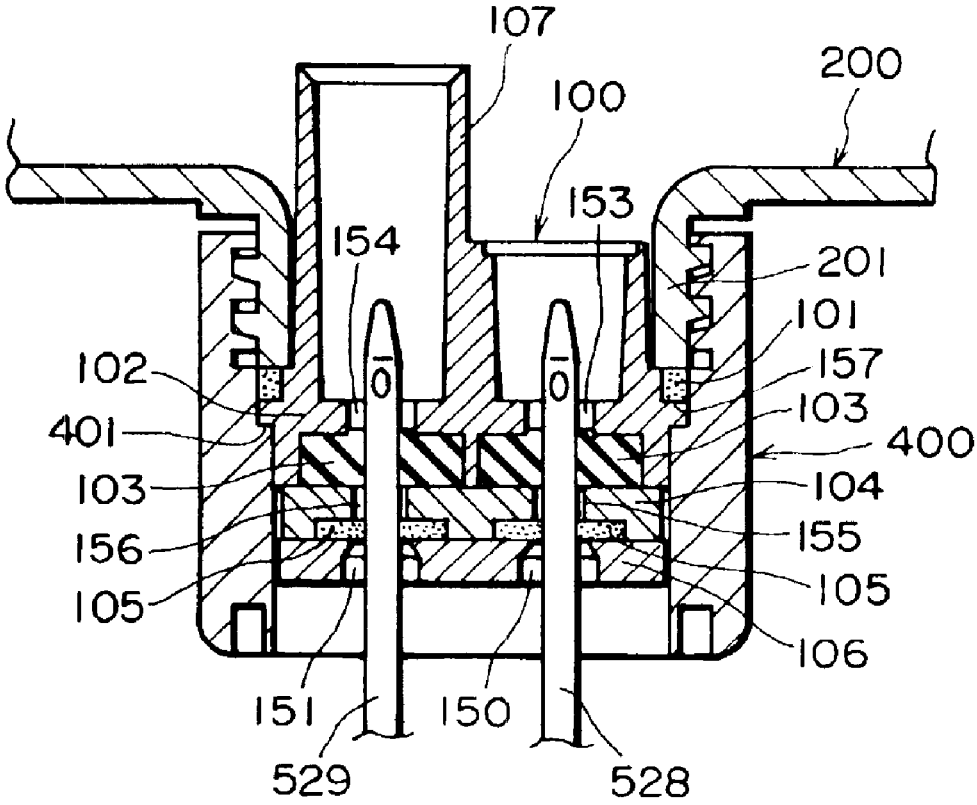
FIG. 5 is an enlarged vertical sectional view of the liquid container depicted in FIGS. 1–4, for showing in detail the structure thereof.
Figure 6:
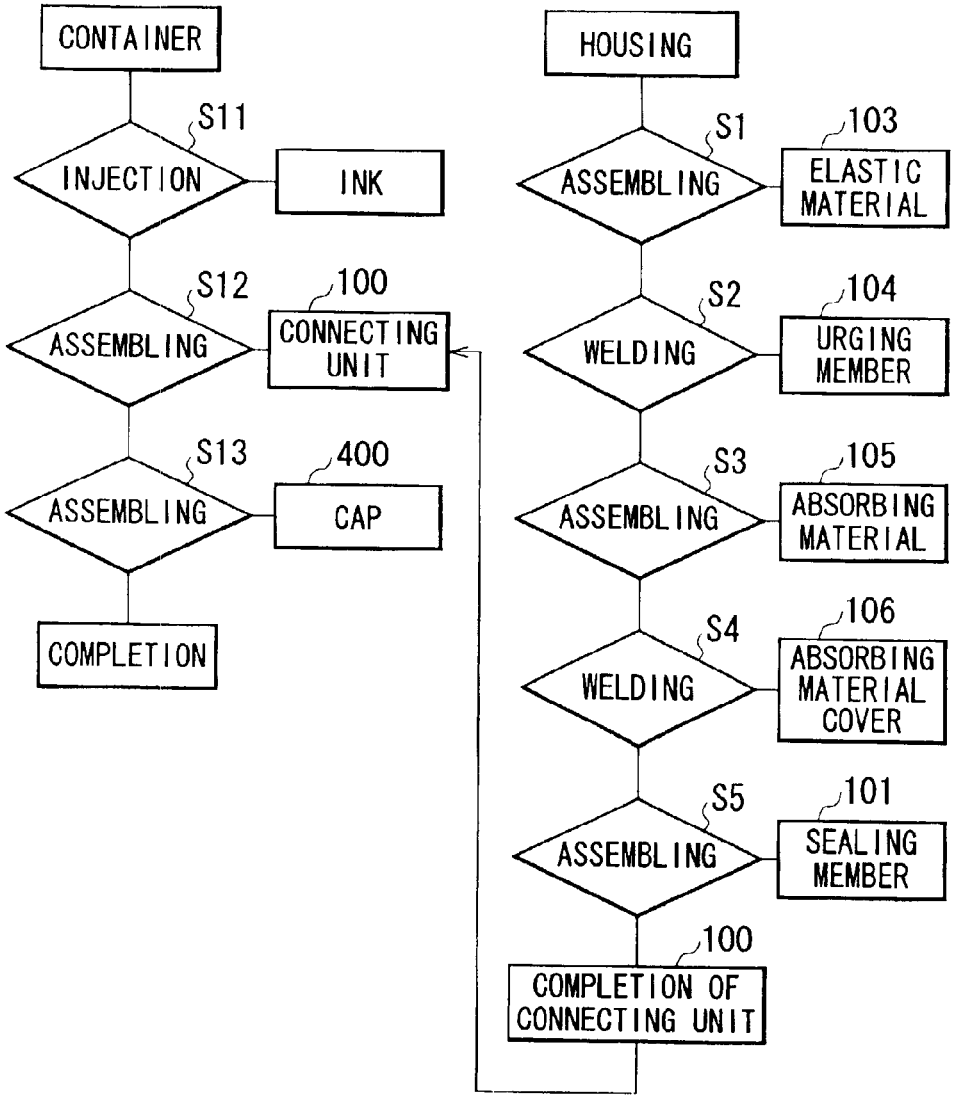
FIG. 6 is a flowchart showing the process for assembling the liquid container in FIG. 1.

FIG. 1 is a schematic perspective view of the first embodiment of the present invention in the form of a liquid container, and FIG. 2 is an exploded schematic perspective view of the liquid container in FIG. 1, for showing the general structure thereof. FIG. 3 is an exploded schematic perspective view of the liquid container in FIG. 2, having been further exploded to show the details of the connective unit in FIG. 2, and FIG. 4 is a sectional view of the combination of the liquid container in FIG. 1 and the ink supplying system of an ink jet recording apparatus employing the liquid container as an ink container, for showing the general structure of the ink supplying system. FIG. 5 is an enlarged vertical sectional view of the liquid container depicted in FIGS. 1–4, for showing in detail the structure thereof, and FIG. 6 is a flowchart showing the process for assembling the liquid container in FIG. 1.

Referring to FIGS. 1–5, a liquid container 1000 in accordance with the present invention is mounted into an ink jet recording apparatus or the like, with the connective portions 150 and 151 of its connective unit 100 facing downward, and is used in this posture. In other words, when the liquid container 1000 is an ink container for an ink jet recording apparatus, it is removably mounted into the liquid container mounting portion of the ink jet recording apparatus so that the connective portions 150 and 151 face downward to supply the ink jet head (recording head) as the recording means of the ink jet recording apparatus, with ink.

The liquid container 1000 comprises a container proper 200 as a liquid storage portion (ink storage portion) for holding liquid (ink), a connective portion 100 for drawing the liquid within the container proper 200 out of the container proper 200, an information storage medium unit 300 from which various information regarding the liquid container 1000 can be read, and a capping member 400. The container proper 200 as an actual liquid storage is a hollow container formed of plastic material using blow molding. The connective unit 100 comprises a plurality (two) connective portions through which a liquid drawing hollow needle and an air introducing hollow needle are put. The connective unit 100 is held to the neck portion 201 of the liquid storage portion 200 by a capping member 400, with the interposition of a sealing member 101 to keep the liquid storage portion 200 sealed. The capping member 400 is for holding the connective unit 100 to the neck portion 201 of the liquid storage portion 200 (container proper), with the interposition of the sealing member 101 for keeping the liquid storage portion 200 sealed, and is screwed onto the neck portion 201; the female threads on the internal surface of the capping member 400 are engaged with the male threads on the peripheral surface of the neck portion 201. Further, the information storage medium unit 300 is firmly fixed, by ultrasonic welding or the like, to the external surface of one of the lateral walls of the liquid storage portion 200, being accurately positioned relative to the liquid storage portion 200.

Next, referring to FIGS. 3–5, the connective unit 100 will be described in more detail. The connective unit 100 structured in accordance with the present invention comprises a plurality (two) connective portions. More specifically, it comprises: a absorbent member cover 106 with a pair of through holes 150 and 151 (connective holes); a housing 102 with a pair of through holes 153 and 154 corresponding, in position, to the through holes 150 and 151 of the absorbent member cover 106, one for one; a pair of elastic members 103, which is formed of rubbery elastic material and is fitted in the housing 102 so that their axial lines align, one for one, with those of the through holes 153 and 154 of the housing 102; a pressing member 104 with through holes 155 and 156 corresponding, in position, to the connective holes 150 and 151; and a pair of absorbent members 105 placed in the recesses of the pressing member 104, one for one. These components are assembled into the connective unit 100.

Then, the liquid storage portion 200 with the neck portion 201, and the connective unit 100 having the connective portion for drawing liquid out of the liquid storage portion 200 and the connective portion for introducing the ambient air into the liquid storage portion 200, are joined, with the elastic members 103 kept compressed within the connective portions, to complete the liquid container 1000.

The connective holes 150 and 151 are parts of the absorbent member cover 106. The pressing member 104 is firmly fixed to the housing 102 by ultrasonic welding, or with the use of a combination of latching claws (unshown), or the like.

The elastic members 103 are in the form of a dome such as the one in the previously described ink container in accordance with the prior art; in other words, they are structured so that as the pressing member 104 is firmly fixed to the housing 102, they are compressed and remain compressed in the housing 102. More specifically, the elastic members 103 each are formed of rubbery elastic material and are in the form of a dome. Therefore, as they are mounted in a pair of recesses of the housing 102, one for one, and are compressed by the pressing members 104, compressive force is generated in the radius direction of the elastic members 103, sealing the liquid storage portion 200.

The two absorbent members 105 in the pressing member 104 remain sandwiched by the pressing member 104 and the absorbent member cover 106. The absorbent member cover 106 is firmly fixed to the pressing member 104 or housing 102 with the use of ultrasonic welding, a combination of latching claws (unshown), or the like. Described above is the general structure of the connective unit 100.

Referring to FIG. 5, in order to securely attach the connective unit 100 to the neck portion 201 of the liquid storage portion 200 (container proper), the capping member 400 having internal threads is screwed onto the neck portion 201 having external threads, with the interposition of the sealing member 101. As a result, the connective unit 100 is securely attached to the neck portion 201, and airtightly seals the liquid storage portion 200.

Also referring to FIG. 5, when the liquid container 1000 is put to use for the first time, that is, when the liquid container 1000 is mounted, for the first time, into an ink jet recording apparatus or the like, it is mounted so that the liquid (ink) drawing needle 538 and air introducing needle 529 go through the connective through holes 150 and 151, penetrates the absorbent members 105 and 106, go through the through holes 155 and 156, penetrate the elastic members 103 and 104, go through the through holes 153 and 154, and enter the container proper 200 of the ink container 1000. As a result, the ink supplying passage and air introducing passage become connected through the connective unit 100, carrying out predetermined functions (supply of ink and the like). As is evident from the preceding description, the connective unit 100 has a plurality (two) connective portions which lead to the plurality (two) of connective holes 150 and 150. The liquid drawing needle 528 is for drawing the liquid in the liquid storage portion 200, whereas the air introducing needle 529 is for introducing the ambient air into the ink storage portion 200.

Referring to FIG. 25, the top portion of the capping member 400 is open as shown in the drawing. Therefore, even after the fixation of the connective unit 100 by the capping member 400, the connective through holes 150 and 151 of the outward end portion (absorbent member cover 106) of the capping member 400 are exposed.

The capping member 400 is structured so that it can be screwed onto the neck portion 201 of the liquid storage portion 200 (container proper); the internal surface of the capping member 400 is provided with a stepped portion 401 so that the connective unit 100 can be reliably held between the neck portion 210 and capping member 400.

The neck portion 201 of the container proper 200 (liquid storage portion), the connective unit 100, and the capping member 400, are structured so that as the capping member 400 is screwed onto the neck portion 201, the sealing member 101 placed between the circumferential flange 157 on the peripheral surface of the housing 102 of the connective unit 100 and the neck portion 201 of the container proper 200, in the housing 102, is compressed by a predetermined amount by the circumferential flange 157 and neck portion 201, keeping the interior of the ink container 1000 sealed from the ambient air.

In other words, the housing 102 of the connective unit 100 is provided with a surface (surface of stepped portion 157) which squarely faces the end surface of the neck portion 201 of the container proper 200 (liquid storage portion), as shown in FIG. 5, whereas the sealing member (in the form of an O-ring) is held, by the application of a predetermined amount of compressive force upon the sealing member 101, in the circumferential groove formed between the peripheral surface of the housing 102 and the internal surface of the capping member 400. Therefore, it is ensured that the interior of the ink storage portion 200 remains airtightly sealed.

Next, the information storage medium unit 300 will be described. Referring to FIG. 3, the information storage medium unit 300 comprises: an information storage medium holder 301; an information storage medium 302 securely fixed to the inward surface of the recess of the information storage medium holder 301, with the use of a piece of two-sided adhesive tape 303, being accurately positioned relative to the holder 301; and an ID portion (mechanical ID portion) made up of a plurality of projections 304 protruding, like the teeth of a comb, from the external surface of the information storage medium holder 301.

First, the information storage medium 302 will be described. This information storage medium 302 is such an information storage medium that while the ink container 1000 (liquid container) is in the proper position in an ink jet recording apparatus, information can be exchanged between the information storage medium 302 and the ink jet recording apparatus. The information exchanged between the information storage medium 302 and ink jet recording apparatus regards the ink expiration date, the amount of the ink remaining in the ink container 1000, ink color, etc. The control section of the ink jet recording apparatus reads the information regarding these aspects of the ink container, and warns a user of the ink expiration date or ink depletion, urging thereby the user to exchange the current ink container with a fresh one. With this arrangement, it is possible to prevent the changes in ink color and/or viscosity from affecting image quality, and also, to prevent the ink jet recording apparatus from carrying out an image forming operation while the ink container is empty, and to prevent the ink jet recording apparatus fitted with a single or plurality of wrong ink containers, that is, ink containers containing ink of wrong color, from carrying out an image forming operation; in other words, it is possible to prevent the formation of defective images. Therefore, it is possible to always carry out a satisfactory image forming operation to output high quality images.

The information storage medium 302 may be virtually any storage medium, for example, a magnetic memory, a magneto-optic memory, an electrical memory, a mechanical memory, etc., as long as identification information can be stored therein, and can be retrieved therefrom by information retrieving means. Further, it may be a flash memory, a magnetic medium such as a WORM, or the like. In the case of the ink container 1000 in this embodiment, an EEPROM, or an electrically erasable programmable read-only memory, is employed as the information storage medium for the liquid container (ink container or the like), which is capable of holding the ink container identification information; into which information can be written from the recording apparatus main assembly side; into which additional information can be written from the recording apparatus main assembly side, to be added to the information pre-existing therein; and, in which the stored information can be altered or erased. This EEPROM is mounted on the substrate of a printed circuit having a contact portion which is to be electrically connected to the electrical connector provided on the recording apparatus main assembly side. The integral combination of these components constitutes the information storage medium 302.

The ID portion 304 formed of a plurality of projections arranged like the teeth of a comb is used as an ID for preventing the ink container from being erroneously mounted. Predetermined teeth of the ID portion 304 have been removed according to the color of the ink therein, the model of the recording apparatus, etc., whereas the portions of the apparatus main assembly side corresponding to the removed teeth of the ID portion 304 on the ink container side are provided with a projection to assure that only a correct ink container (model, color, etc.) can be mounted. In other words, the ink container is prevented by not only the information stored in the information storage medium, but also this mechanical arrangement, from being erroneously mounted.

Next, referring to FIG. 4, an example of the ink supply system (recording liquid supply system) of an ink jet recording apparatus, with which the liquid container 1000 (ink container) in this embodiment is connected, will be described. FIG. 4 is a drawing showing the general structure of the recording liquid supplying system which connects the liquid container 1000 to the ink jet head 524 (recording head), as a recording means, with the interposition of the aforementioned connective unit 100, so that ink can be ejected from the ink jet head onto recording medium to form images on the recording medium.

The recording head 524 (ink jet head) as a recording means is such an ink jet recording means that ejects ink with the use of thermal energy. It comprises a single or plurality of electrothermal transducers for generating thermal energy. More specifically, in the recording means 524 (recording head), the ink in the ink jet head is made to boil in the so-called film-boiling manner by the thermal energy applied to the ink by the electrothermal transducers, and the pressure change caused by the growth and contraction of the bubbles generated by the boiling of the ink is used to eject the ink from the ejection orifices to record images.

Figure 10:
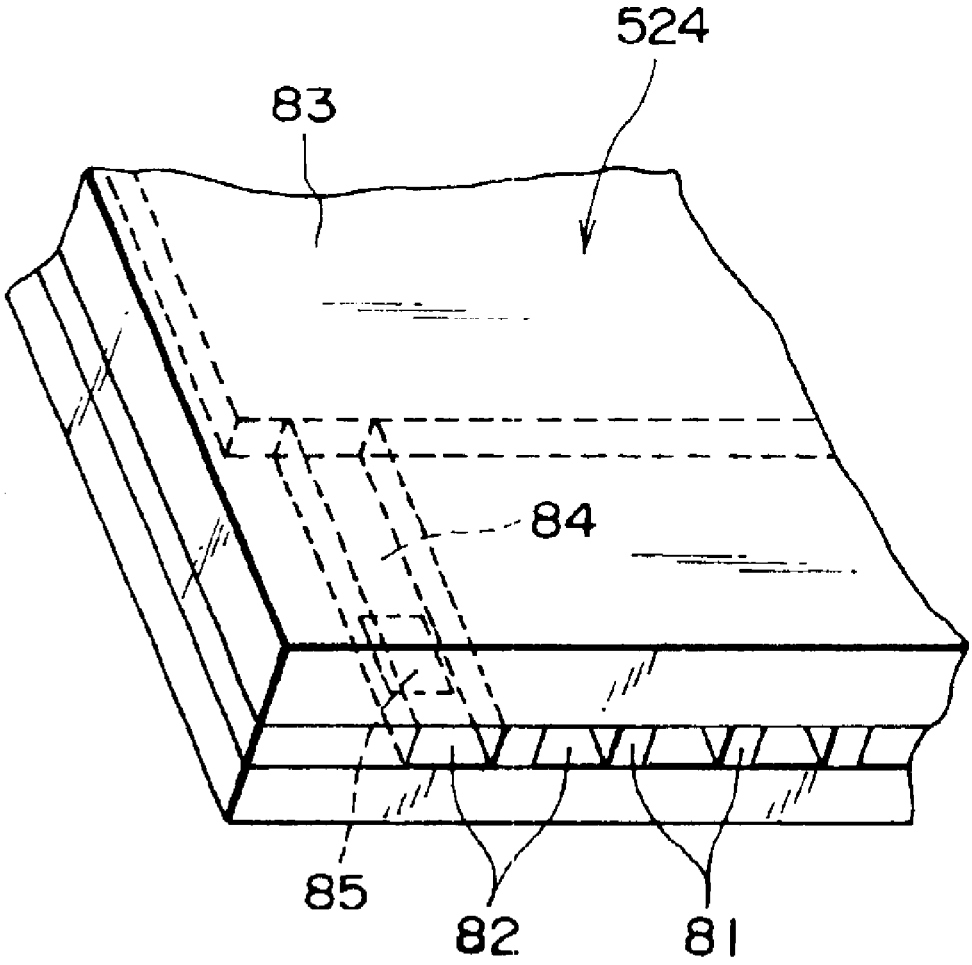
FIG. 10 is a schematic perspective view of the ink ejecting portion of an ink jet head, as an recording means, in FIG. 4, for showing the structure thereof.
Figure 11:
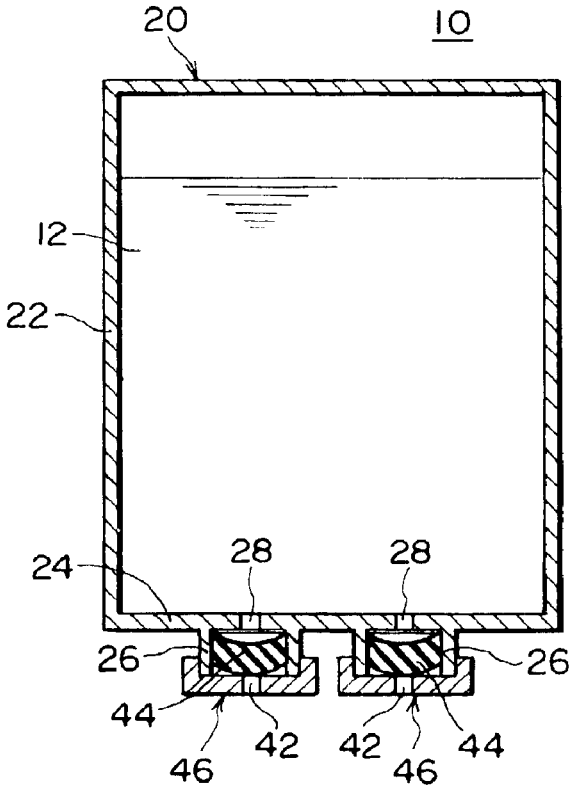
FIG. 11 is a schematic vertical sectional view of an example of an ink container in accordance with the prior art, as a liquid container of an exchangeable type, employed as a preferable liquid container for an ink jet recording apparatus.
Figure 12:
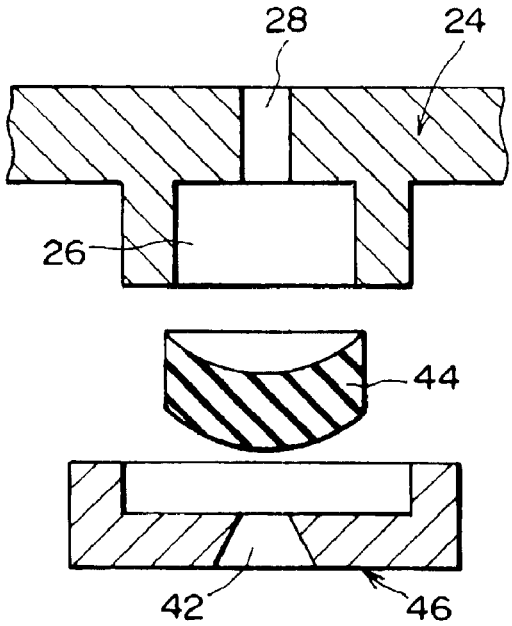
FIG. 12 is an exploded vertical sectional view of the liquid outlet portion (connective portion) of the liquid container in accordance with the prior art, in FIG. 11.

FIG. 10 is a schematic perspective view of the ink ejecting portion of the recording head 524, for showing the structure thereof. In FIG. 10, a surface 81 having a plurality of ejection orifices 82 faces recording medium, such as recording paper, with the presence of a predetermined gap (approximately 0.2–2.0 mm, for example). The ejection orifices 82 are arranged at a predetermined pitch. Each ejection orifice 82 is connected to the common liquid chamber by a liquid passage 84. Each of the liquid passages 84 is provided with an electrothermal transducer 84 (heat generating resistive member or the like), which is for generating the energy for ejecting ink and is on one of the walls of the liquid passage 84. As the electrothermal transducer 85 is driven (supplied with electrical power) by image formation signal or ejection signals, the ink within the liquid passage 84 is boiled in the film-boiling manner, and therefore, a certain amount of the ink within the ink passage 84 is ejected from the ejection orifice 82 by the pressure generated by the boiling of the ink.

Referring to FIG. 4, the recording head 524 (ink jet head) is connected to the ink container 1000 by the ink supplying tube 526. The end of the ink supplying tube 526 on the ink container 1000 side is connected to the buffer chamber 530 of the ink supplying unit 525. The ink supplying unit 525 is provided with a hollow ink supplying needle (ink drawing needle) 528 and a hollow air introducing needle 529, which are connected to the buffer chamber 530. The ink supplying needle for drawing the liquid (ink) from the liquid storage (ink storage portion) 200 is made to penetrate through the elastic member 103 placed in alignment with the first connective hole 150 of the ink container 1000, and reach the internal space of the ink storage portion (container proper) 200, so that the ink within the liquid storage portion (container proper) 200 can be supplied (drawn) through the opening located in the adjacencies of the tip of the ink supplying needle 528. Since the elastic member 103 is in the compressed state, it presses on the peripheral surface of the ink supplying needle 528, sealing the interface between the elastic member 103 and the peripheral surface of the ink supplying needle 528, preventing therefore the ink within the ink storage portion 200 from leaking.

As described above, the ink supplying unit 525 is provided with the air introducing needle 529 connected to the buffer chamber 530. The air introducing needle 529 is made to penetrate through the elastic member placed in alignment with the second connective hole 151 of the ink container

1000, and reach the internal space of the ink storage portion 200, in the similar manner as is the ink supplying needle 528, so that air (atmospheric air) can be introduce into the ink storage portion 200 through the opening of the needle 529, which is located near the tip of the needle 529. Also in this case, the elastic member 103 is in the compressed state. Therefore, the elastic member 103 presses on the peripheral surface of the air introducing needle 529 having penetrated the elastic member 103, sealing the interface between the elastic member 103 and the needle 529.

The buffer chamber 530 is provided with an air passage 527, one end of which is connected to the top portion of the buffer chamber 530, and the other end of which is open to the ambience of the ink supplying unit 525. The air introducing needle 529 reaches the approximate center of the buffer chamber 530 in terms of the height direction of the buffer chamber 530, whereas the ink drawing needle (ink supplying needle) 528 does not reach as high as the air introducing needle 529. Normally, the buffer chamber 530 is filled with ink, up to the bottom end of the air introducing needle 529, so that the space unfilled with ink is left as a buffer zone.

In this embodiment, the ink storage portion 200 of the ink container 1000 is provided with a cylindrical portion 107, which is structured so that as the ink container 1000 is connected to the ink supplying unit 525, the air introducing needle 529 penetrates into the internal space of the cylindrical portion 107, while being laterally surrounded by the cylindrical wall of the cylindrical portion 107. As the ambient air is introduced into the ink storage portion 200 (cylindrical portion 107) through the aforementioned opening of the air introducing needle 529, it forms bubbles in the ink storage portion 200. Therefore, in order to prevent these bubbles from remaining in the cylindrical portion 107, a sufficient amount of clearance is provided between the peripheral surface of the air introducing needle 529 and the internal lateral surface of the cylindrical portion 107.

The cylindrical portion 107 is made tall enough so that it is impossible of the top end of the air introducing needle 529 to reach as high as the top edge of the cylindrical portion 107. The ink supplying needle 528 and air introducing needle 529 are formed of electrically conductive material, making it possible to detect, from the change in electrical resistance between the ink drawing needle 528 and air introducing needle 529, that the amount of the ink remaining in the ink container 1000 has fallen below a predetermined value. More specifically, as the ink level within the ink storage portion 200 falls below the top edge of the cylindrical portion 107 due to ink consumption, electrical current stops flowing between the ink drawing needle 528 and air introducing needle 529. Thus, it is possible to detect, by detecting this electrical current stoppage, that the amount of the ink remaining within the ink storage portion 200 has reduced to a critical point.

In order to facilitate the detection of this electrical current stoppage, the top edge of the cylindrical portion 107 is chamfered so that as the ink level falls past the top edge of the cylindrical portion 107, the body of ink within the cylindrical portion 107 is quickly disconnected from the body of ink outside the cylindrical portion 107. In this embodiment, the height of the cylindrical portion 107 is set so that the moment the amount of the ink remaining in the ink storage portion 200 falls below 10% can be detected. Incidentally, the cylindrical portion 107 may be structured for stirring the ink within the ink storage portion 200 to make the ink circularly flow within the ink storage portion in order to disturb the sedimentary pigments so that the ink is restored in terms of pigment dispersion. Further, the portion through which the ink supplying needle 528 is inserted may be provided with a cylindrical portion similar to the cylindrical portion 107, so that a filter can be attached to the opening of the cylindrical portion to make the ink within the ink storage portion 200 go through the filter as it is drawn out of the ink storage portion 200. The selection of the material for this filter is optional. For example, it is possible to employ fibers formed of the same material as that for the ink container 1000, fibrous sheet, porous material, material molded of beads, porous material formed with the use of solvent, etc.

Next, referring to FIG. 4, which shows the ink supply system in the ink Jet recording apparatus, the ink drawing operation (ink supply operation) carried out when the liquid container 1000 in the first embodiment described with reference to FIGS. 1–5 is employed as an ink container will be described. Referring to FIG. 4, in order to record images on recording medium (paper, etc.), the ink jet head 524 ejects ink from the plurality of ejection orifices 82 in the surface 81 of the ink jet head 524. As ink is ejected, the ink is supplied to the ink jet head 524 through the ink supplying tube 526, compensating for the ejected ink.

The ink supplying tube 526 connecting the connective unit 100 and recording head 524 is provided with the ink supplying unit 525, (position of which may be in the middle of the ink supplying tube 525). As ink is supplied from the ink storage portion 200 to the ink jet head 525, the amount of the ink within the ink storage portion 200 reduces. As a result, the internal pressure of the ink storage portion 200 reduces. Then, the air within the buffer chamber 530, which has been introduced into the buffer chamber 530 through the air passage 527 of the ink supplying unit 525, is introduced into the ink storage portion 200 (container proper) 200, through the air introducing needle 529.

In the ink jet recording apparatus, the ink supplied to the ink jet head 524 must be kept under a predetermined amount of negative pressure. In the case of the ink supply system in this embodiment, the opening 529*a* located in the bottom end of the air introducing needle 529 for introducing air into the container proper 200 of the ink container is positioned lower than the surface 81 of the ink jet head 524 having the ejection orifices 82. The difference in height (head) between the opening 529*a* and the surface 81 provides the ejection orifices 82 with constant negative pressure. In other words, regardless of the position of the surface of the ink within the ink container 1000, the ejection orifices 82 of the ink jet head 524 are almost always provided with a predetermined amount of negative pressure.

Next, referring again to FIG. 4, what will happen as the air within the liquid container 200 expands or contracts due to the changes in environmental factors, for example, temperature, atmospheric pressure, etc., will be described. As the air within the liquid storage portion 200 expands, the liquid (ink) is pushed into the buffer chamber 530 through the air introduction tube (needle) 529. Thus, the buffer chamber 530 is given a capacity large enough for the ink to be prevented from overflowing from the buffer chamber 530 even if the predictable environmental changes occur. Further, should the ink overflow, the ink is absorbed by an absorbent member (unshown) positioned at the tip of the air passage 537 for absorbing waste ink. Therefore, as long as the amount by which the ink overflows is relatively small, the components and portions of the recording apparatus other than the absorbent member are not soiled by the ink. On the other hand, as the air within the liquid storage portion 200 contracts, the air (ambient air) is introduced into the ink container 1000 through the hollow air introducing needle 529.

In this embodiment, the structure for introducing air through the air introducing needle 529 was employed as a structure for compensating for the pressure drop which occurs in the ink storage portion 200 due to the ink supply to the ink jet head 524. However, this is not mandatory. For example, a system for supplying liquid to the connective unit 100 when certain conditions are met may be connected to the second connective hole (connective hole for air introduction) of the connective unit 100, so that ink (liquid) is supplied for compensating for the above described pressure drop. In this case, the compensatory liquid (ink) may be of the same kind of liquid as that stored in the ink storage portion (container proper) 200.

Next, the manufacturing process for the above described ink container 1000 will be described. FIG. 6 is a flowchart showing an example of the manufacturing process for the ink container (liquid container) 1000 in accordance with the present invention.

First, referring to FIGS. 5 and 6, the order in which the various components are assembled to make the connective unit 100 will be described. In Step S1, the two elastic members 103 are put into the housing 102, and in Step S2, the pressing member 104 is firmly fixed to the housing 102 by ultrasonic welding. Then, in Step S3, the two absorbent member 105 are fitted into the recesses of the pressing member 104, which are on the side opposite to the elastic members 103, and in Step S4, the absorbent member cover 106 is firmly fixed to the pressing member 104 by ultrasonic welding. Then, in Step S5, the sealing member 101 is fitted around the housing 102 in such a manner that it is placed in contact with the lateral surface of the flange portion of the housing 102, on the ink storage 200 side. The connective unit 100 is completed through the above described steps S1–S5. The connective unit 100 may be manufactured in a process separated from the manufacturing process for the liquid storage portion 200 and the process for filling the liquid storage portion 200 with ink.

Next, referring to FIGS. 5 and 6, the order in which the various components are assembled to make the liquid container (ink container) 1000 will be described. Referring to FIG. 6, in Step S11, ink is poured into the liquid storage portion (container proper) 200. After the pouring of the ink, the connective unit 100 completed through the above described steps S1–S5 is fitted into the opening of the neck portion (ink outlet portion) 201 of the ink storage portion 200, with the sealing member 101 interposed between the edge of the neck portion 201 and the connective unit 100, and the capping member 400 with the internal threads is screwed onto the male threads on the peripheral surface of the neck portion (ink outlet portion) 201, so that the connective unit 100 is held sandwiched between the capping member 400 and liquid storage portion (container proper) 200, with the liquid storage portion 200 remaining airtightly sealed.

In this state, the connective holes 150 and 151 of the connective unit 100 are exposed at the outward end of the capping member 400, and the interface between the connective unit 100 and liquid storage portion 200 becomes airtightly sealed with the sealing member 101 as the capping member 400 is screwed onto the neck portion (ink outlet portion) 201 of the liquid storage portion 200, with the connective unit 100 held sandwiched between the neck portion 201 and capping member 400.

Through the above described steps, the liquid storage portion 200 with the neck portion (liquid outlet portion) 201 is united with the connective unit 100 comprising the connective portion (having connective hole 150) for drawing liquid from the liquid storage portion, the connective portion (having connective hole 151) for introducing air into the liquid storage portion, and the elastic members 103 held compressed in contact with the connective portions. As a result, the liquid container 1000 in accordance with the present invention is obtained.

As is evident from the preceding description of an example of the embodiment of the present invention, according to the present invention, it is possible to provide connective units which comprise the portion for drawing liquid out of the liquid container and the portion for introducing air into the liquid container, and yet, is simple and compact in structure, highly precise, and reliable in terms of sealing performance. Therefore, it is possible to provide liquid containers which are excellent in terms of the productivity of the process for pouring liquid into the liquid container.

According to the structured described above, the connective unit 100 can be preassembled in a process separated from the other assembly processes. Therefore, after pouring ink into the liquid storage portion 200, the connective unit 100 can be firmly fixed to the neck portion (liquid outlet portion) 201 of the liquid storage portion 200 with the use of the capping member 400, making it possible to quickly and airtightly seal the liquid storage portion 200. Therefore, unlike the liquid containers in accordance with the prior art, the liquid containers in accordance with the present invention do not need to be put through a plurality of manufacturing steps, with the ink inlet left open after the pouring of ink into the liquid storage portion 200. Therefore, ink is not likely to leak, eliminating the need for the equipment and apparatuses necessary for handling the liquid containers in accordance with the prior art, during the manufacturing process. Further, it is unnecessary to reduce the amount by which ink is filled (reducing the amount by which ink is filled results in reduction in ink storage efficiency).

Moreover, a plurality of connective portions (having connective holes 150 and 151, for example) are prepared in advance as parts of the connective unit 100, making it possible to use, as an ink inlet, the neck portion (liquid outlet portion) 201, to which the connective unit 100 is attached.

In other words, it is possible to provide the liquid container 1000 with an ink inlet substantially larger than that of a liquid container in accordance with the prior art, making it possible to pour liquid into the liquid container 1000 at a higher rate; the productivity of the ink pouring process can be improved.

In addition, this ink inlet is airtightly sealed as the connective unit 100 is attached, eliminating the need for special sealing members and sealing steps. Therefore, it is possible to reduce the component count and assembly steps, and also, it does not increase cost.

Further, the connective unit 100 can be manufactured in a process independent from the ink pouring process. Thus, even if one group of ink containers are different in the shape of the ink storage portion from another group of ink containers, both groups can be made compatible with the connective unit 100 in accordance with the present invention, by making identical their connective portions by which they are joined with the connective unit 100. In other words, the connective unit 100 in accordance with the present invention is easily applicable to various types of liquid containers, making it possible to prepare the devices only by the necessary number, that is, without waste; common components can be used for various ink containers, making it easier to control the ink container production.

Further, the capping member 400 is structured so that it can be firmly fixed to the liquid storage portion 200 by being screwed onto the liquid storage portion 200. Therefore, an additional effect is obtained; after the liquid container 1000 is used up, the connective unit 100 can be easily removed from the ink storage portion (container proper) 200, making it easier to refill the liquid storage portion 200 with liquid (ink). In other words, there is the effect that the liquid container 1000 can be easily reused.

Moreover, it is easier to separately discard the connective unit 100 formed of a plurality of materials inclusive of the material for the elastic members 103 and the monolithic liquid storage portion (container proper) 200 formed of a single material.

Additionally, the capping member can be screwed onto the liquid storage portion 200 while holding the connective unit 100 in a predetermined position with the use of a jig or the like. Therefore, it is easier to accurately position the connective holes. Also as described above, the sealing member 101 is sandwiched between the connective unit 100 and neck portion (liquid outlet portion) 201. Therefore, the amount by which the torque generated by the screwing of the capping member 400 onto the liquid storage portion 200 is transmitted to the sealing member 101 is smaller. Thus, it is less likely for the sealing member 101 to be bent or twisted, ensuring that the liquid storage portion 200 is airtightly sealed. These effects (accurate positioning, ensuring of airtightness of liquid storage portion) can also be realized by firmly fixing the capping member 400 to the liquid storage portion 200 by welding.

As described above, in this embodiment, the liquid container 1000 is structured so that the connective unit 100 is firmly fixed to the liquid storage portion 200, being sandwiched between the neck portion 201 and capping member 400, by screwing the capping member 400 onto the neck portion 201 with the interposition of the sealing member 101 between the liquid storage portion 200 and connective unit 100. The application of the present invention, however, is not limited to this structural arrangement. For example, the liquid container 1000 may be structured so that the connective unit 100 is directly welded, or screwed into or onto, the neck portion (liquid outlet portion) 201 of the ink storage portion (container proper) 200. With the provision of the above described structural arrangements, not only can the above described effects be realized, but also, a substantial number of components equivalent to the sealing member 101 and capping member 400 can be eliminated, and also, all that is necessary to be done after the pouring of ink into the liquid storage portion 200 is to firmly fix the connective unit 100 by welding; only one manufacturing step is required after the ink pouring. Thus, the structure in which the connective unit 100 is directly fixed to the liquid storage portion 200 is preferable in terms of component count and assembly step count.

According to this embodiment of the present invention, it is possible to integrally place a plurality of connective holes in a single connective unit 100, requiring only one pressing member 104. Therefore, unlike the connective unit in accordance with the prior art, the number of the pressing member 104 does not need to be equal to the number of the connective holes. Therefore, not only the component count and assembly step count smaller, but also the cost, are smaller. Regarding this advantage, the greater the number of the necessary connective holes, the greater the effects of this embodiment. In other words, this effect is greater in the case of a liquid container having the connective hole for waste ink introduction in addition to the connective hole for ink supply and connective hole for air introduction (total of three connective holes) than in the case of a liquid container, like the ink container in the above described embodiment, having two connective holes, that is, the connective hole for ink supply and connective hole for air introduction.

Further, in this embodiment, the pressing member 104 is monolithic. Therefore, the elastic members 103 are less nonuniform in terms of compression ratio, compared to those in accordance with the prior art. Therefore, it is possible to provide liquid containers higher in reliability.

Further, unlike the ink containers in accordance with the prior art, the portion of the pressing member 104, which faces the housing 102, does not need to be provided for each of the plurality of connective holes. Therefore, the distance between the connective holes 150 and 151 can be reduced. Therefore, it is possible to reduce the liquid container size, and also, to reduce the sizes of the apparatuses, such as recording apparatuses, to which the liquid container is applicable. Incidentally, in the case of liquid containers in accordance with the prior art, which are provided with connective holes different in size (for example, hole on ink supply side is greater than hole on air introduction side), a plurality of pressing members different in size are necessary, whereas in the case of liquid containers in accordance with this embodiment, only a single pressing member 104 is necessary.

In this embodiment, the plurality of connective portions each are provided with the absorbent member 105.

Therefore, the ink adhering to the connective holes 150 and 150 and their adjacencies when removing the liquid container (ink container) 1000 from an apparatus (ink Jet recording apparatus, etc.), is quickly absorbed, preventing the hands of users from being soiled with the ink.

Also in this embodiment, the ink storage portion (container proper) 200 is manufactured by blow molding. With the use of blow molding, hollow sealable containers can be easily produced without the need for lids or the like, making it possible to reducing the component count and assembly step count, in proportion to the number of the unnecessary components such as lids. Increasing liquid container (ink container) size increases (widen) the welding seam size between the container proper and the lid. Therefore, the reliability of the welding seam reduces. However, manufacturing the ink storage portion of a liquid container by blow molding as in this embodiment eliminates this problems. Incidentally, the internal volume of the liquid container (ink container) in this embodiment was approximately 400 cc.

Figure 7:
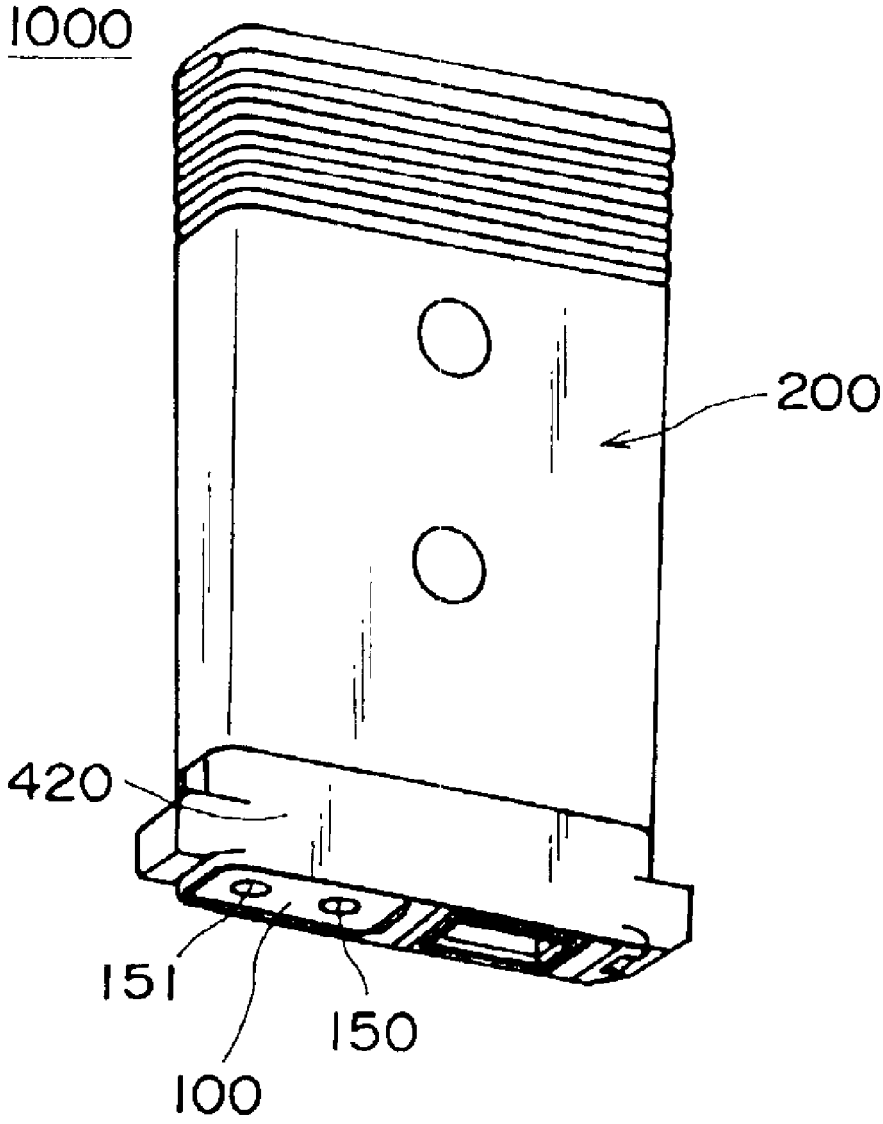
FIG. 7 is a schematic perspective view of the second embodiment of the present invention in the form of a liquid container.
Figure 8:
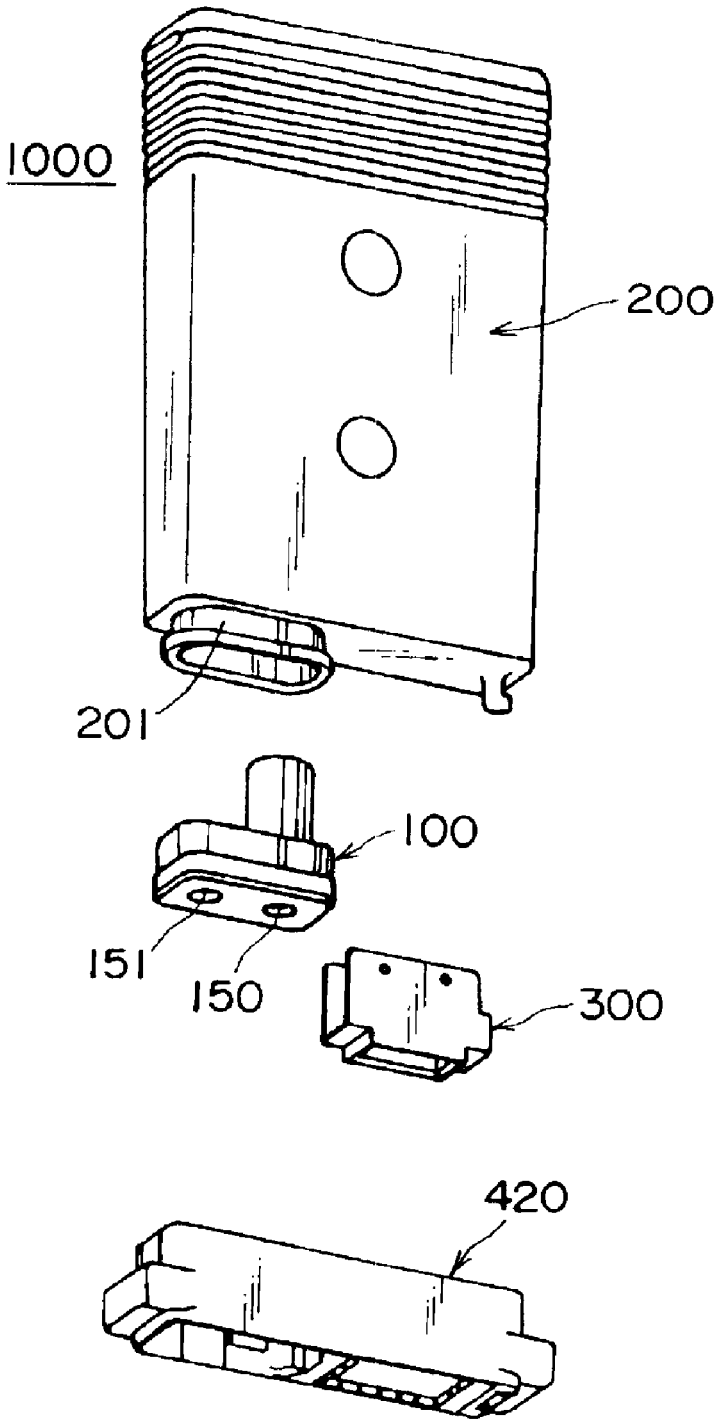
FIG. 8 is an exploded schematic perspective view of the liquid container in FIG. 7, for showing the general structure thereof.
Figure 9:
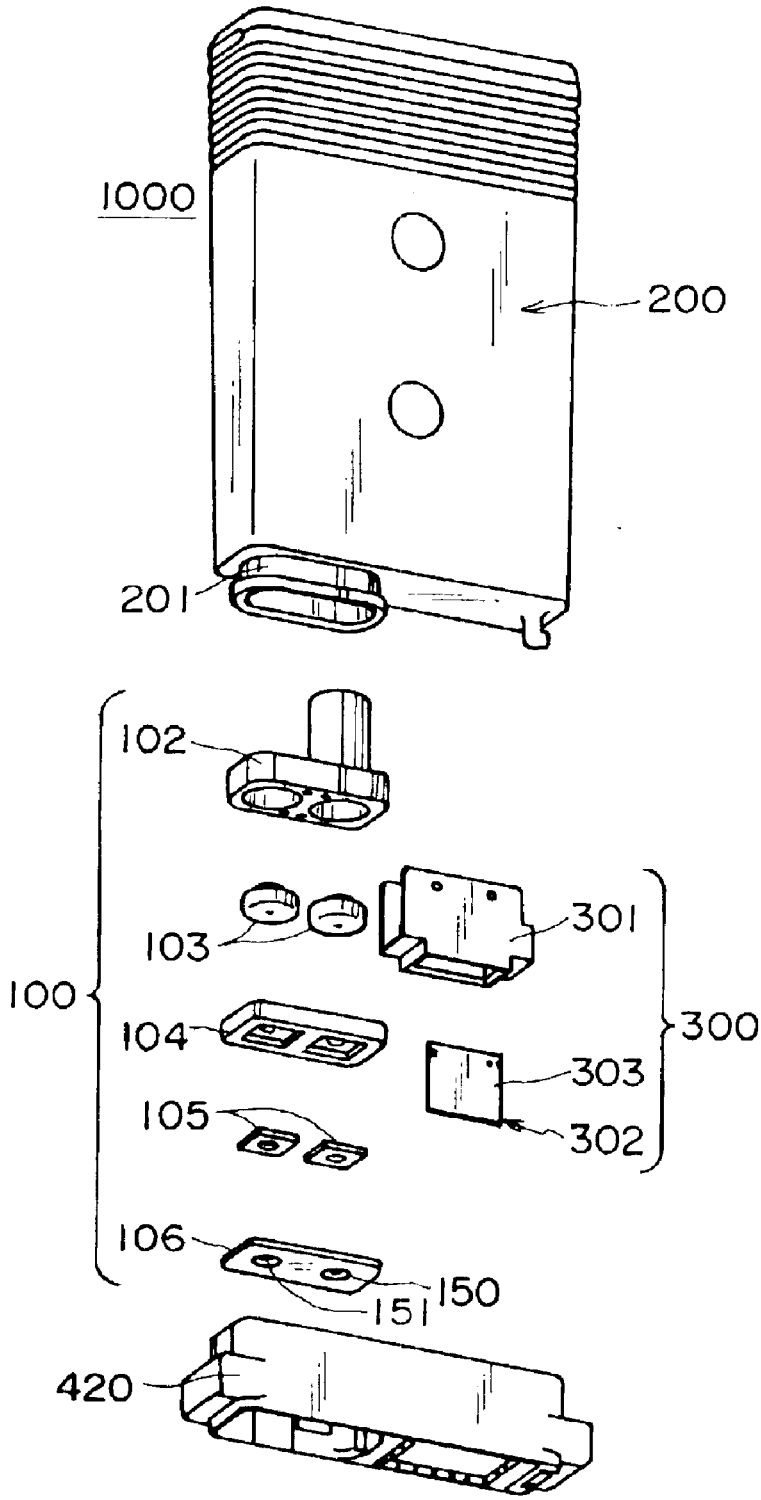
FIG. 9 is an exploded schematic perspective view of the liquid container in FIG. 7, having been further exploded to show the details of the connective unit in FIG. 7.

FIG. 7 is a schematic perspective view of the second embodiment of the liquid container in accordance with the present invention, and FIG. 8 is an exploded schematic perspective view of the liquid container in FIG. 7, for showing the general structure thereof. FIG. 9 Is an exploded schematic perspective view of the connective unit depicted in FIG. 8, for showing the details thereof. Next, referring to FIGS. 7–9, another example (second embodiment) of the liquid container in accordance with the present invention will be described.

Referring to FIGS. 7–9, the second embodiment of the liquid container 1000 in accordance with the present invention is mounted into a recording apparatus or the like so that the connective holes 150 and 151 of the connective unit 100 face downward, and so that they remain facing downward during its usage. Therefore, the portion of the liquid container 1000 having the connective unit 100 comprising the connective holes 150 and 151 constitutes the bottom portion. More specifically, when the liquid container 1000 is an ink container for an ink jet recording apparatus, it is removably mounted into the ink container mounting portion of the ink jet recording apparatus, with the connective holes 150 and 151 positioned on the bottom side, and is used for supplying ink to the ink jet head, as a recording means, of the ink jet recording apparatus.

Referring to FIG. 8, the liquid container 1000 comprises a liquid storage portion (ink storage portion) 200 for holding liquid (ink), a connective unit 100 for drawing the liquid within the liquid storage portion 200 out of the liquid storage portion 200, an information storage medium unit 300 from which various information regarding the liquid container 1000 can be read, and a guarding member 420.

In this embodiment, the liquid storage portion 200 is a flat hollow container formed of plastic material using blow molding. A flat hollow container is employed to reduce the size of an apparatus, such as a recording apparatus or the like, into which a plurality of liquid containers (ink containers) are mounted.

The connective unit 100 comprises a plurality (two) connective portions, a housing 102 having a plurality (two) through holes corresponding in position to the connective holes 150 and 151 leading to the connective portions, a pair of elastic members 103 formed of rubbery elastic material and positioned, one for one, corresponding to the through holes of the housing 102, a pressing member 104 having a pair of through holes corresponding in position to these elastic members 103, a pair of absorbent members 105 placed in contact with the pressing member 104, and an absorbent member cover 106 placed on the outward side of the absorbent members 105. These components are integrally assembled to make the connective unit 100. Also in this embodiment, the connective holes 150 and 151 are parts of the absorbent member cover 106.

The pressing member 104 is firmly fixed to the housing 102 by ultrasonic welding, or with the use of a combination of latching claws (unshown), or the like. The elastic members 103 are in the form of a dome; in other words, they are structured so that as the pressing member 104 is firmly fixed to the housing 102, they are compressed and remain compressed in the housing 102. The two absorbent members 105 placed in contact with the pressing member 104 are held to the pressing member by being sandwiched between the pressing member 104 and the absorbent member cover 106. The absorbent member cover 106 is firmly fixed to the pressing member 104 or housing 102 by ultrasonic welding or with the use of a combination of latching claws (unshown), or the like. Through the above described steps, these components are assembled into the connective unit 100. The connective unit 100 is firmly fixed to the liquid storage portion 200 by welding the housing 102 to the edge of the opening of the neck portion (liquid outlet portion) 200 with the use of ultrasonic waves.

Further, in the case of the liquid container 1000 in the second embodiment depicted in FIGS. 7–9, after the fixing of the connective unit 100 to the liquid storage portion 200, the guarding member 420 which is structured for protecting the connective unit 100, and is provided with a snap (securing means made up of hooking projections, and holes providing edges on which projections latch) so that it can be reliably attached to the bottom wall of the liquid storage portion 200, is attached to the bottom surface of the liquid storage portion 200 in a manner to cover the connective unit 100.

The guarding member 420 is provided for protecting the welded connective unit 100, and also, for holding and protecting the information storage medium unit 300.

For the same reason as that in the first embodiment, that is, in order to prevent the liquid container 1000 from being erroneously mounted, one of the lengthwise ends of the guarding member 420 is provided with a mechanical ID made up of a plurality of projections arrange like the teeth of a comb.

Concerning the above described features of the liquid container 1000, the liquid container 1000 in the second embodiment of the present invention depicted in FIGS. 7–9 has virtually the same structure as that in the first embodiment described with reference to FIGS. 1–6. The main differences of the second embodiment from the first embodiment are as follows.

Firstly, the liquid storage portion 200 in the second embodiment is a flat container as depicted by the drawings.

Therefore, the employment of the liquid containers in the second embodiment makes it possible to reduce the size of an apparatus, such as a recording apparatus, which employs a plurality of liquid containers (ink containers).

Secondly, the integrally assembled connective unit 100 is firmly fixed to the liquid storage portion 200 by ultrasonic welding or the like, eliminating the components equivalent to the sealing member 101 and capping member 107 in the first embodiment. In other words, the application of the second embodiment makes it possible to further simplify the liquid container structure and reduce the component count.

Thirdly, in the second embodiment, the ink container 1000 is structured so that the guarding member 420 is attached to the bottom surface of the liquid storage portion 200 with the use of a snap (securing means made up of hooking projections, and holes providing edges on which projections latch) in order to protect and retain the welded connective unit 100 and information storage medium unit 300. Further, the guarding member 420 is provided with the mechanical ID made up of a plurality of projection arranged like the teeth of a comb to prevent the erroneous mounting of the liquid container 1000.

Therefore, effects similar to the effects obtained by the first embodiment described in detail with reference to FIGS. 1–6 can also be realized by the second embodiment depicted in FIGS. 7–9.

In the preceding embodiments, the present invention was described with reference to the case in which the number of the connective portions provided in the connective unit 100 was two. The present invention, however, is also applicable to cases in which no less than three connective portions are provided in the connective unit, and such application yields the same effects as those described above. In other words, ink containers having no less than three connective portions in the connective unit fall within the scope of the present invention.

In the preceding embodiments, the cross section of the connective portion 100 was circular or rectangular. However, the shape of the cross section of the connective unit 100 is optional. For example, it may be elliptical, triangular, or may have any polygonal shape other than the preceding ones.

As for the compatibility of the present invention with ink jet recording apparatuses having a liquid container mounting portion into which the above described liquid container 1000 is mountable, the present invention is applicable to various ink jet recording apparatuses in terms of recording method, and the application produces effects similar to those described above, regardless of their recording methods. For example, the present invention is compatible with: serial type ink jet recording apparatuses which record images by moving the recording head, as a recording means, in the primary scanning direction; line type ink jet recording apparatuses which record images by moving, only in the secondary scanning direction, a line type recording head which is long enough to partially or entirely cover the width of recording medium; etc.

Further, the present invention is applicable to various ink jet recording apparatuses regardless of the number of recording heads mounted in the apparatuses. For example, the present invention is compatible with: ink jet recording apparatuses employing only a single recording head; color ink jet recording apparatuses employing a plurality of recording heads different in ink color; gradation recording ink jet recording apparatuses employing a plurality of recording heads which are identical in ink color but are different in ink content; combination ink jet recording apparatuses, that is, those employing a combination of the recording methods of the preceding types of ink jet recording apparatuses; etc., and the application produces the effects similar to those described above.

Moreover, the present invention is applicable to various ink jet recording apparatuses regardless of the positioning of the recording heads and liquid containers (ink containers), and the application produces effects similar to those described above.

Further, the present invention is applicable to various ink jet recording apparatuses regardless of the means with which liquid (ink) is ejected. For example, the present invention is also applicable to ink jet recording apparatuses which employs a single or plurality of ink jet recording heads employing electromechanical transducers such as piezoelectric elements; ink jet recording apparatuses employing a single or plurality of ink jet recording heads which use thermal energy to eject ink; etc. In particular, the present invention has excellent effects upon the apparatuses employing the recording heads which use thermal energy, making it possible to record (print), more precisely at a higher density.

As is evident from the above description of the present invention, according to an aspect of the present invention directed to a liquid container, a liquid container is made up of a combination of a liquid storage portion having an opening, and a connective unit which is located at the opening of the liquid container and has a single or plurality of connective portions through which the liquid within the liquid container can be drawn. Therefore, even an ink container having a plurality of connective portions, inclusive of the connective portion for drawing liquid out of the liquid container and the connective portion for introducing air into the liquid container, can be made simple and compact in the structure of the connective portion, highly precise, and superior in reliability and efficiency with which liquid is poured into the liquid container.

According to another aspect of the present invention, a liquid container is structured so that the connective hole for drawing liquid from the liquid container and connective hole for introducing air into the liquid container are placed in the connective unit, and so that elastic members are held compressed in the connective unit. Therefore, the above described effects are enhanced.

According to a further aspect of the present invention, a liquid container is structured so that the connective unit is firmly fixed to the liquid storage portion by welding. Therefore, all that is necessary to do after the pouring of liquid into the liquid container is to firmly fix the connective unit to the liquid storage portion. In other words, the present invention has the effect of reducing to only one, the number of manufacturing steps necessary after the pouring of ink.

According to a further aspect of the present invention, a liquid container is structured so that the connective unit is firmly fixed to the liquid storage portion with the use of the capping member which also firmly fixed to the liquid storage portion by being screwed onto the liquid storage portion, making it possible for-the connective unit to be easily removed from the liquid storage portion after the depletion of the liquid within the liquid container. Therefore, not only can liquid containers be easily refilled with ink, for reuse, but also it is easier to separately discard the connective unit formed of a plurality of materials inclusive of the material for the elastic members, and the liquid storage portion, that is, the container proper, formed of a single material.

According to a further aspect of the present invention, a liquid container is structured so that the connective portion is provided with a plurality of connective holes, and so that a hollow needles for drawing liquid out of the liquid container, and a hollow needle for introducing air into the liquid container, are put through the connective portions. Therefore, the numbers of the necessary pressing members and the like do not need to be as large as the number of the connective portions; it is possible to make do with only a single pressing member or the like. Therefore, it is possible to reduce the component count and manufacturing step count, as well as manufacturing cost. Further, it is possible to reduce the nonuniformity in the compression ratio of the elastic members traceable to the nonuniformity in the component properties, making it possible to improve liquid containers in reliability. Further, it is unnecessary to provide each of the connective portions with its own connective components such as the pressing member, making it possible to reduce the pitch of the connective members. Therefore, it is possible to reduce the liquid container size. Further, even if a liquid container must be equipped with a plurality of connective portions different in size, the numbers of the components other than the connective portions, for example, the pressing member, do not need to be increased.

According to a further aspect of the present invention, a liquid container is structured so that an absorbent member is placed in the connective portion. Therefore, as liquid adheres to the connective portions and their adjacencies when a liquid container is removed, the absorbent member quickly absorbs the liquid, preventing the hands of users from being soiled by the liquid.

According to a further aspect of the present invention, the liquid storage portion, which is a hollow container, is structured so that it can be manufactured with the use of blow molding, that is, a molding method capable of easily forming a hollow container, eliminating the need for a discrete lid or the like. Therefore, it possible to manufacture a larger liquid container which is reliable in terms of airtightness or the like, in spit of the larger size.

According to a further aspect of the present invention, an ink container is structured so that it can contain ink, and so that it can be removably mountable in an ink jet recording apparatus which ejects ink from its recording means onto recording medium to form images, the ink jet recording apparatus being provided with a mounting portion into which the liquid container is mountable, the recording means of the ink jet recording apparatus being provided with electrothermal transducers for generating the thermal energy used for ejecting ink, and ejecting ink from the ejection orifices with the use of the film-boiling caused in the ink by the thermal energy generated by the electrothermal transducers. Therefore, the above described effects are enhanced.

According to a further aspect of the present invention, an ink container is structured so that the connective unit to be united with the liquid storage portion having an opening, in order to form a liquid container for an ink jet recording apparatus, is provided with a single or plurality of connective portions for enabling the liquid within the liquid container to be drawn out of the liquid container. Therefore, it is possible to provide a connective unit for a liquid container, which has a plurality of connective portions, inclusive of the connective portion for drawing liquid out of the liquid container and the connective portion for introducing air into the liquid container, and yet, are simple and compact in the structure of the connective portion, highly precise, highly reliable in terms of the airtightness, and highly productive in terms of the efficiency with which liquid is poured into the liquid container.

According to a further aspect of of the present invention, the connective unit is structured so that it is provided with the connective hole for drawing liquid from the liquid storage portion, and the connective hole for introducing air into the liquid storage portion, and so that the elastic members are placed, compressed, in the connective unit. Therefore, the above described effects are enhanced.

According to a further aspect of the present invention, the connective unit is structured so that it is firmly fixed to the liquid storage portion by welding. Therefore, only manufacturing step which must be completed after the pouring of liquid into the liquid storage portion is to firmly fix the connective unit to the liquid storage portion; in other words, after the pouring of ink, there is only one manufacturing step to complete the ink container.

According to a further aspect of the present invention, the connective unit is structured so that it is firmly fixed to the liquid storage portion with the use of the capping member which is firmly fixed to the liquid storage portion by being screwed onto the liquid storage portion. Therefore, after the depletion of the ink within the liquid container, the connective unit can be easily removed from the liquid storage portion, making it easier to refill the liquid container with liquid in order to reuse the liquid container, and also, to separately discard the connective unit formed of a plurality of materials, inclusive of the material for the elastic members, and the container proper of the liquid container formed of a single material.

According to a further aspect of the present invention, the connective unit is structured so that it is provided with a plurality of connective holes, and so that a hollow needle for drawing liquid and a hollow needle for introducing air are put through the connective portions of the connective unit. Therefore, the number of the pressing members or the like do not need to be as large as the number of the connective portions; in other words, it is possible to made do with only a single pressing member or the like. Therefore, it is possible to reduce the component count, manufacturing step count, as well as the liquid container cost. Further, it is possible to minimize the nonuniformity in the compression ratio of the elastic member, traceable to the nonuniformity in the component properties. Therefore, it is possible to improve the ink container in reliability. In addition, it is unnecessary to provide each connective portion with connective components such as the pressing member. Therefore, it is possible to reduce the pitch of the connective portions, making it possible to reduce the liquid container size. Further, even when it is necessary to provide a connective unit with a plurality of connective portions different in size, the numbers of the pressing members and the like does not need to be increased.

According to a further aspect of the present invention, the connective unit is structured so that the connective portions of the connective unit is provided with the absorbent member. Therefore, as liquid adheres to the connective portions and their adjacencies when the liquid container is removed, the absorbent member quickly absorbs the liquid, preventing the hands of users from being soiled by the liquid.

According to a further aspect of the present invention, the liquid storage portion, which is a hollow container, is structured so that it can be manufactured by blow molding. Therefore, the liquid storage portion does not require a discrete lid or the like, making it possible to manufacture a larger liquid storage portion which is highly reliable in terms of airtightness, in spite of its larger size.

According to a further aspect of the present invention, the liquid container compatible with the connective unit is structured so that it is removably mountable in an ink jet recording apparatus which ejects ink onto recording medium to form images, the ink jet recording apparatus being provided with a mounting portion into which the liquid container having the connective unit is mountable, the recording means of the ink jet recording apparatus, in which the liquid container having the connective unit is mounted, being provided with electrothermal transducers for generating thermal energy used for ejecting ink, and ejecting ink from the ejection orifices with the use of the film-boiling caused in the ink by the thermal energy generated by the electrothermal transducers. Therefore, the above described effects are enhanced.

While the invention has been described with reference to the structures disclosed herein, it is not confined to the details set forth, and this application is intended to cover such modifications or changes as may come within the purposes of the improvements or the scope of the following claims.

What is claimed is:

1. A liquid container for containing liquid for effecting ink jet recording, said liquid container being detachably mountable to a mounting portion of an ink jet printer, said liquid container comprising:

a container body constituting a liquid containing portion for accommodating the liquid, said container body having only an opening portion constituting only one opening, said opening portion including threads therearound;

a connecting unit assembly for plugging said opening and for connection with a connecting portion provided in the mounting portion of the ink jet printer, said connecting unit assembly comprising a housing and an elastic member fitted to said housing, and further comprising an absorbing material outside of said elastic member, wherein said elastic member is constructed to accept a through-insertion of the connecting portion of the ink jet printer; and a mounting member having threads corresponding to said threads of said container body, for mounting said connecting unit assembly to said opening portion by screwing said mounting member using said threads of said container body and said mounting member to seal said opening against the liquid.

2. A liquid container according to claim 1, wherein the connecting portion of the ink jet printer is provided with a receiving tube for receiving liquid from said liquid container and an air introduction tube for introducing air into said liquid container, wherein said connecting unit assembly has a liquid discharge portion into which said receiving tube is insertable and an air introduction portion into which said air introduction tube is insertable, and wherein said liquid discharge portion and air introduction portion are each comprised of said absorbing material and said elastic member such that said receiving and air introduction tubes are connected with said absorbing material and said elastic member in this order.

3. A liquid container according to claim 1, wherein said liquid container contains ink.

4. A liquid container according to claim 1, wherein said liquid container contains pigment ink.

5. A liquid container for containing liquid for effecting ink jet recording, said liquid container being detachably mountable to a mounting portion of an ink jet printer, the mounting portion being provided with a receiving tube for receiving liquid from said liquid container and an air introduction tube for introducing air into said liquid container, said liquid container comprising:

a container body constituting a liquid containing portion for accommodating the liquid, said container body having only an opening portion constituting only one opening, said opening portion including threads therearound;

a connecting unit assembly for plugging said opening, said connecting unit assembly comprising a housing having a liquid discharge portion and an air introduction portion, wherein said liquid discharge portion is fitted with a first elastic member into which said receiving tube is insertable and an absorbent material outside of said first elastic member, and wherein said air introduction portion is fitted with a second elastic material into which said air introduction tube is insertable and an absorbent material outside said second elastic member;

a mounting member having threads corresponding to said threads of said container body, for mounting said connecting unit assembly to said opening by screwing said mounting member using said threads of said container body and said mounting member to seal said opening against the liquid; and liquid accommodated in said container body, wherein the liquid, when said container is mounted to the mounting portion, is discharged through said discharging portion in accordance with a printing operation of the apparatus, and the air is introduced through the air introduction portion into said container body, by which the liquid is stirred.

6. A liquid container according to claim 5, wherein the liquid is pigment ink.

7. A manufacturing method for a liquid container for containing liquid for effecting ink jet recording, said liquid container being detachably mountable to a mounting portion of an ink jet printer, said method comprising:

a step of preparing a container body constituting a liquid containing portion for accommodating the liquid, said container body having only an opening portion constituting only one opening, said opening portion including threads therearound;

a step of assembling a connecting unit assembly for plugging said opening and for connection with a connecting portion provided in the mounting portion of the ink jet printer, said connecting unit assembly comprising a housing and an elastic member fitted to said housing and further comprising an absorbing material outside of said elastic member, wherein said elastic member is constructed to accept a through-insertion of the connection portion of the ink jet printer;

a step of preparing a mounting member having threads corresponding to threads of said container body, for mounting said connecting unit assembly to said opening portion by screwing said mounting member using said threads of said container body and said mounting member to seal said opening against the liquid;

a step of filling the liquid through the opening;

a step of placing said connecting unit assembly in said opening; and a step of screwing said mounting member by using said threads of said container body and said mounting member to seal said opening against the liquid.

* * * * *